US011478722B2

(12) United States Patent
Kamiyama

(10) Patent No.: US 11,478,722 B2
(45) Date of Patent: Oct. 25, 2022

(54) MODEL TOY AND PAN TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 138 days.

(21) Appl. No.: 16/881,606

(22) Filed: May 22, 2020

(65) Prior Publication Data

US 2020/0368634 A1 Nov. 26, 2020

(30) Foreign Application Priority Data

May 23, 2019 (JP) ..... JP2019-096645

(51) Int. Cl.
*A63H 33/30* (2006.01)

(52) U.S. Cl.
CPC ..... *A63H 33/3055* (2013.01)

(58) Field of Classification Search
CPC ..... A63H 33/3055; A63H 33/26; A63H 3/52
See application file for complete search history.

(56) References Cited

U.S. PATENT DOCUMENTS 3,685,936 A 8/1972 Meth et al.
4,332,101 A 6/1982 Tomita
4,345,402 A * 8/1982 Hanson ..... A63H 17/008 124/31
4,467,553 A 8/1984 Kanda
5,118,321 A * 6/1992 Greenberg ..... A63H 3/52 446/486
5,160,288 A * 11/1992 Seda ..... A63H 33/30 446/236

(Continued)

FOREIGN PATENT DOCUMENTS

CN 107073344 A 8/2017
DE 2101017 A1 7/1971

(Continued)

OTHER PUBLICATIONS

Chinese Office Action dated Jul. 21, 2021 in Chinese Patent Application No. 202010432586.4 (7 pages) with an English translation (8 pages).

(Continued)

*Primary Examiner* — Eugene L Kim
*Assistant Examiner* — Alyssa M Hylinski
(74) *Attorney, Agent, or Firm* — Faegre Drinker Biddle & Reath LLP

(57) ABSTRACT

A model toy includes: a placement member; a first movable member which includes an engaging portion and which is movable to a position that is distant from the placement member; and a second movable member which is urged toward the placement member, which includes an engaged portion that is engaged with the engaging portion when the first movable member is moved, and which is movable to a position that is distant from the placement member. The model toy further includes a guide portion which changes a path of one or both of the engaging portion and the engaged portion as the second movable member is moved, to disengage the engaged portion from the engaging portion.

7 Claims, 7 Drawing Sheets

(56) References Cited

U.S. PATENT DOCUMENTS

| | | | | |
|---|---|---|---|---|
| 5,380,231 | A * | 1/1995 | Brovelli | A63H 17/02 446/6 |
| 6,106,356 | A | 8/2000 | Trageser | |
| 6,287,560 | B1 | 9/2001 | Fujii | |
| 8,568,193 | B1 * | 10/2013 | Evans | A63H 33/3055 446/168 |
| 2004/0259466 | A1 * | 12/2004 | Maxwell | A63H 33/042 446/487 |
| 2005/0142984 | A1 * | 6/2005 | Kiyosue | A63H 33/26 446/296 |
| 2007/0197124 | A1 * | 8/2007 | Sato | A63H 11/00 446/129 |
| 2008/0096463 | A1 | 4/2008 | Wojtkiewicz et al. | |
| 2009/0075559 | A1 * | 3/2009 | Barthold | A63H 17/00 446/470 |
| 2010/0093254 | A1 * | 4/2010 | Jung | A63H 3/20 446/376 |
| 2015/0079874 | A1 * | 3/2015 | Strauss | A63H 33/18 446/308 |
| 2015/0122903 | A1 * | 5/2015 | Boyce | A63H 18/02 238/10 A |
| 2017/0274292 | A1 | 9/2017 | Kanai et al. | |
| 2018/0256995 | A1 | 9/2018 | Kanai et al. | |
| 2018/0311593 | A1 * | 11/2018 | Choi | A63H 33/26 |
| 2019/0099663 | A1 | 4/2019 | Shindo et al. | |
| 2019/0143235 | A1 | 5/2019 | Kanai et al. | |

FOREIGN PATENT DOCUMENTS

| | | | |
|---|---|---|---|
| FR | 1140049 | A | 7/1957 |
| GB | 805421 | A | 12/1958 |
| GB | 2349835 | A | 11/2000 |
| JP | 2006-340968 | A | 12/2006 |
| JP | 2017-221560 | A | 12/2017 |
| WO | WO-A1-2004-041395 | | 5/2004 |

OTHER PUBLICATIONS

Extended European Search Report dated Oct. 5, 2020 in corresponding European patent application 20175736.6 (10 pages).

RU Office Action dated Nov. 18, 2020 from corresponding Russian patent application No. 2020116539 (with attached English-language translation).

The Second Office Action dated Jan. 27, 2022 in Chinese Patent Application No. 202010432586.4 (8 pages) with a English translation (8 pages).

* cited by examiner

MODEL TOY AND PAN TOY

CROSS-REFERENCES TO RELATED APPLICATIONS

This application is based on and claims priority from Japanese Patent Application No. 2019-096645 filed on May 23, 2019, the entire contents of which are incorporated herein by reference.

FIELD

One or more embodiments of the present invention relate to a model toy and a pan toy.

BACKGROUND

Model toys modeled on kitchen equipment, kitchen tools, etc., have been proposed. For example, JP-A-2006-340968 discloses a toy including a main structure that is modeled on a gas cooker on top of which an auxiliary body modeled on a double-handed pot with a lid or a frying pan is put. A handle of the auxiliary body modeled on a frying pan is gripped by a human body portion of the main structure which is modeled on a hand. The auxiliary body is moved repeatedly in the left-right direction following a movement of the human body portion, which allows an infant to learn a movement as if he or she were swinging an actual frying pan on an actual gas cooker.

SUMMARY

However, in the frying pan disclosed in JP-A-2006-340968, there is no coordination between the frying pan and a cooking target and hence it is difficult for a user to enjoy a change between states during or before and after cooking easily.

An object of one or more embodiments of the present invention is to provide a model toy and a pan toy that allow a user to enjoy a change in state easily.

In one aspect of the invention, there is provided a model toy including: a placement member; a first movable member which includes an engaging portion and which is movable to a position that is distant from the placement member; a second movable member which is urged toward the placement member, which includes an engaged portion that is engaged with the engaging portion when the first movable member is moved, and which is movable to a position that is distant from the placement member; and a guide portion which changes a path of one or both of the engaging portion and the engaged portion as the second movable member is moved, to disengage the engaged portion from the engaging portion.

In another aspect of the invention, there is provided a pan toy including: a pan bottom member; a first movable member which includes an engaging portion and which is movable to a position that is distant from the pan bottom member; a second movable member which is urged toward the pan bottom member, which includes an engaged portion that is engaged with the engaging portion when the first movable member is moved, and which is movable to a position that is distant from the pan bottom member; a guide portion which changes a path of one or both of the engaging portion and the engaged portion as the second movable member is moved, to disengage the engaged portion from the engaging portion; a pan frame member which is formed on an outer circumference of the pan bottom member and which is configured to push down the first movable member to the position that is distant from the pan bottom member; and a long handle which is integrally connected to the pan frame member.

According to one or more embodiments of the invention, it is possible to provide a model toy and a pan toy that allow a user to enjoy a change in state easily.

BRIEF DESCRIPTION OF DRAWINGS

FIG. 6A shows a state that is caused by pushing down a manipulation portion of the pan toy and FIG. 6B shows a state that a second movable member is disengaged from a first movable member by pushing down the manipulation portion of the pan toy further.

DETAILED DESCRIPTION

Figure 1:
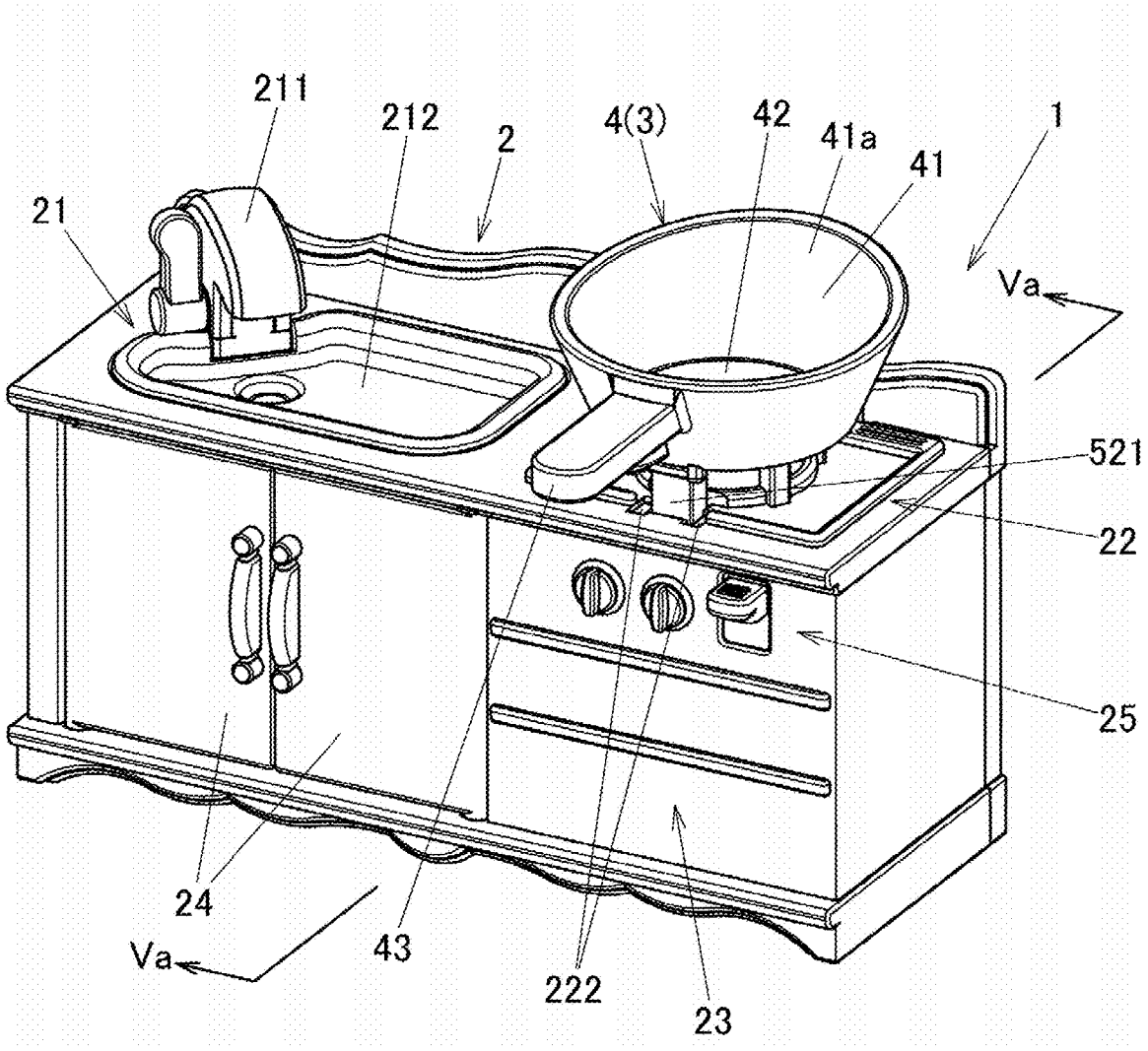
FIG. 1 is an overall perspective view of a kitchen toy according to an embodiment of the present invention.
Figure 2:
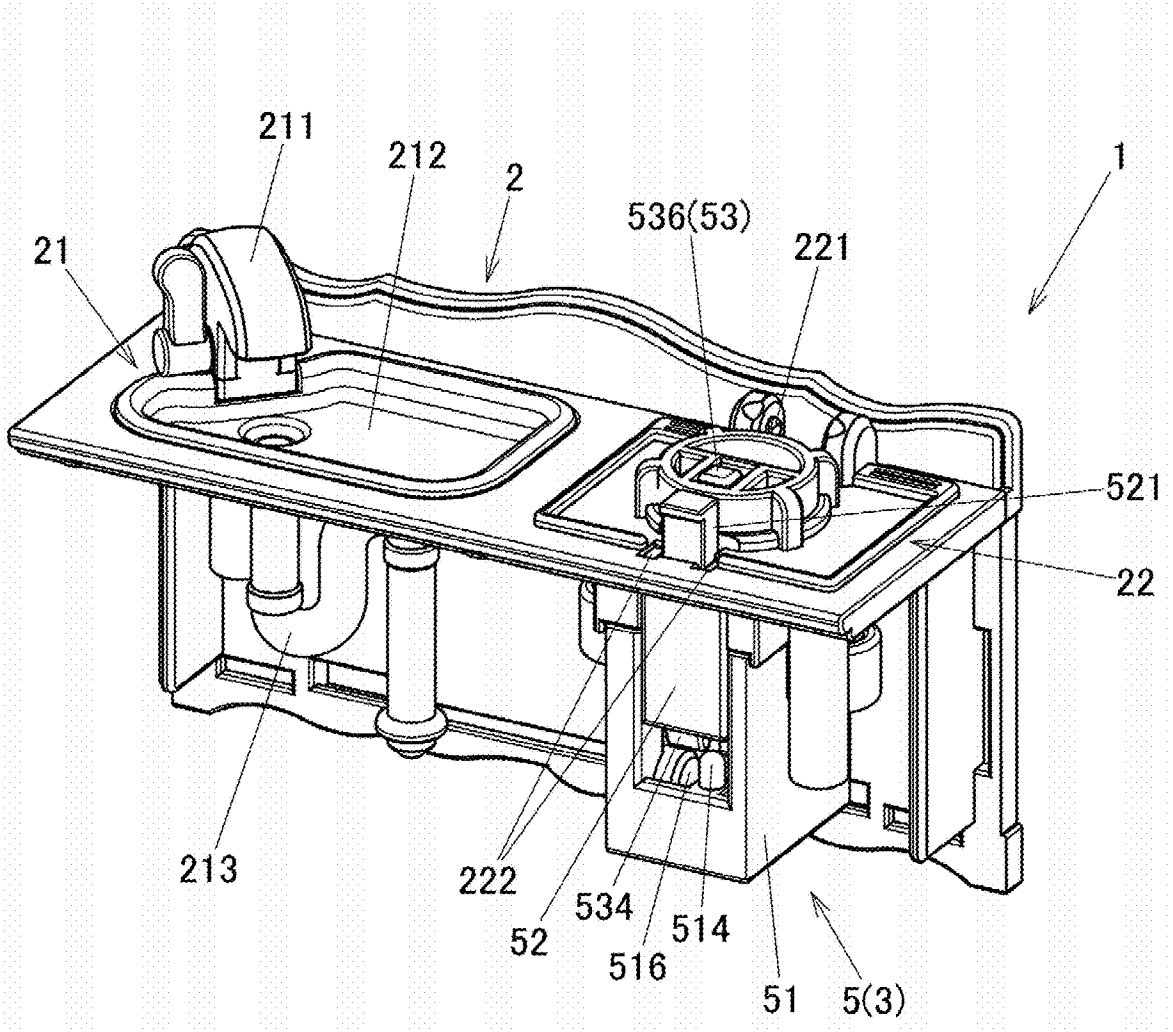
FIG. 2 is a perspective view of the kitchen toy according to the embodiment in which an outer wall and a pan toy are omitted.

An embodiment of the present invention will be hereinafter described with reference to the drawings. FIG. 1 is an overall perspective view of a kitchen toy 1. FIG. 2 is a perspective view of the kitchen toy 1 in which an outer wall 23 of the kitchen toy 1 and a pan main body 4 are omitted. The kitchen toy 1 is a toy that allows a player to do a cooking play using a doll or the like. The pan main body 4 is put on the kitchen toy 1. A hitting mechanism 5 which allows the player to exert impact on a pan bottom member 42 by pushing down a manipulation portion 43 of the pan main body 4 is provided in the kitchen toy 1. When impact is exerted on the pan bottom member 42, a cooking target Fd (see FIGS. 5A and 5B to FIG. 7) that is placed on the pan bottom member 42 is bounced up. In this manner, a play that mimics cooking can be done easily. In the following description, the side of doors 24 of the kitchen toy 1 and the side opposite to it will be referred to as the front side and the back side, respectively. And the side of a cooking stove 22 as viewed from the front side of the kitchen toy 1 and the side opposite to it will be referred to as the right side and the left side, respectively.

The kitchen toy 1 is approximately shaped, as a whole, like a cuboid that is long in the horizontal direction and is equipped with, at its top, a main body 2 which is provided with a sink stage 21 and the cooking stove 22 and a pan toy 3 which is disposed adjacent to the cooking stove 22. The outer wall 23 of the kitchen toy 1 is configured in such a manner that a front wall, left and right side walls, and a bottom wall are unitized with each other. The doors 24 which are swing-open doors and a manipulation portion 25 that is modeled on a manipulation knob of the cooking stove 22 are formed on the front side in the kitchen toy 1.

The sink stage 21 is provided with a faucet 211 and a sink 212. As shown in FIG. 2, a drain pipe 213 which extends so as to communicate with a drain portion of the sink 212 (modeled on an actual conduit) is provided under the sink 212 in the kitchen toy 1.

The pan toy 3 which is disposed adjacent to the cooking stove 22 includes the pan main body 4 and the hitting mechanism 5 for hitting the pan main body 4 (actually the pan bottom member 42) from below. A pair of shafts 221 are provided on the back side portion of the cooking stove 22 so as to support the pan main body 4 rotatably and to project so as to be opposed to each other (one of the support shafts is not shown). As shown in FIG. 2, the hitting mechanism 5 is provided inside the kitchen toy 1 and at least part of top end portions of a first movable member 52 and a second movable member 53 (described later) can come into contact with the pan main body 4.

Figure 3:
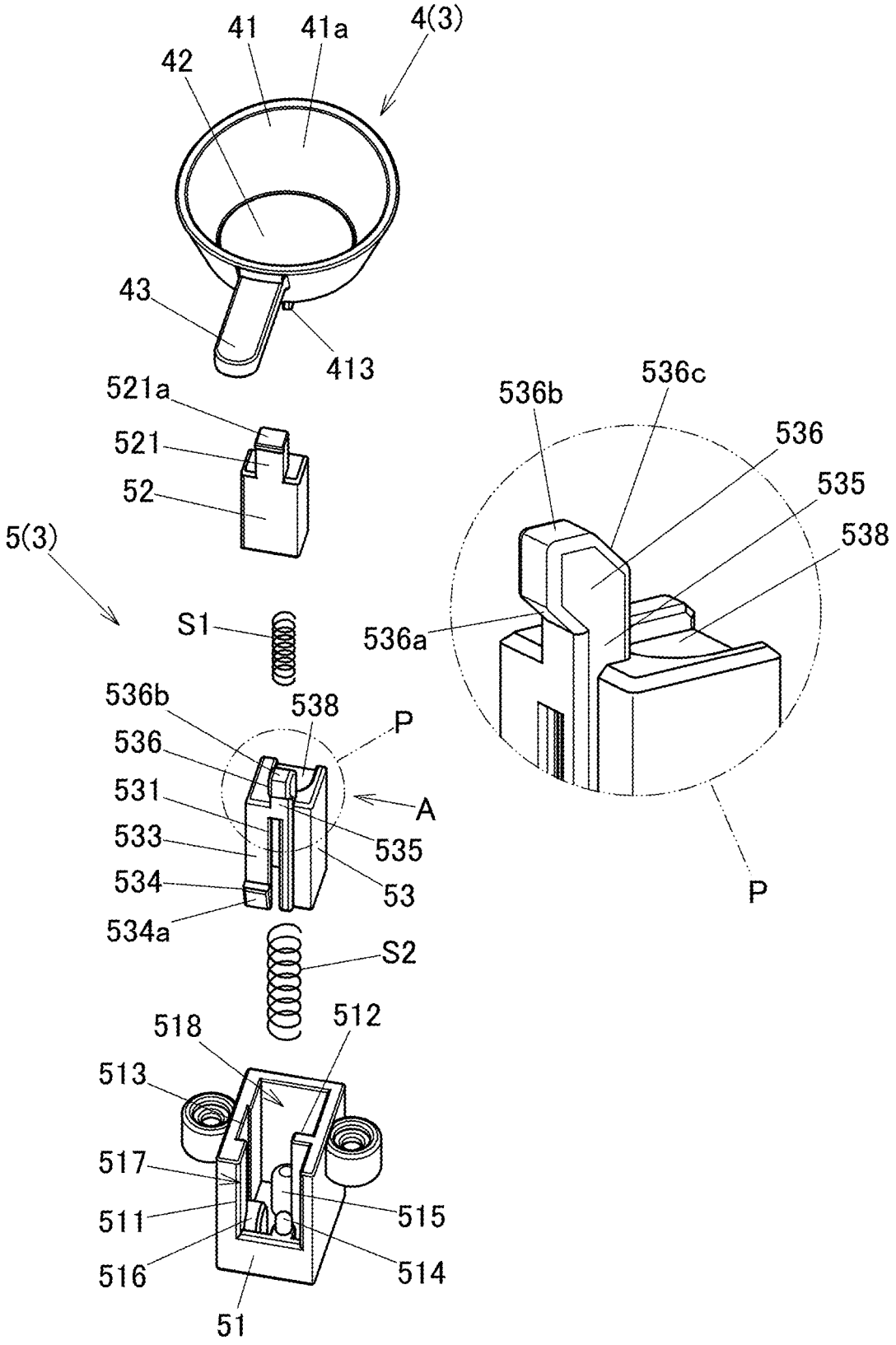
FIG. 3 is an exploded perspective view of the pan toy according to the embodiment as viewed obliquely from the top-front side.
Figure 4:
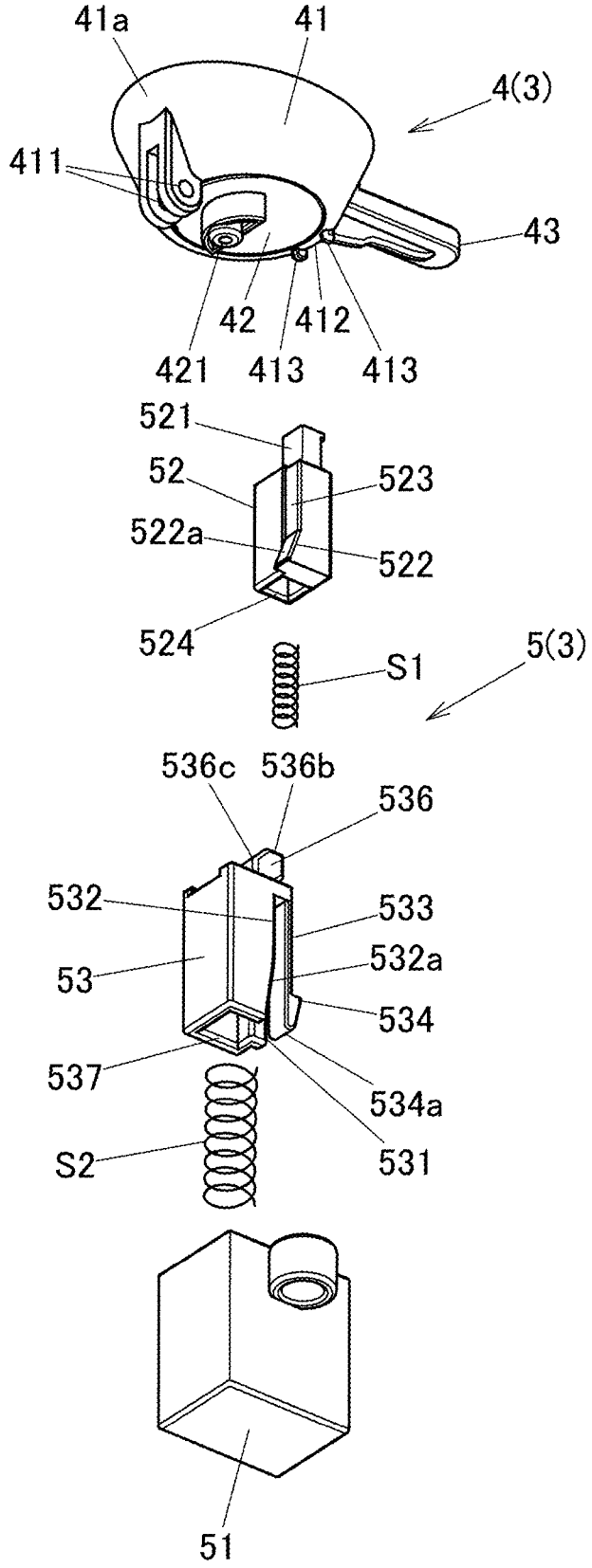
FIG. 4 is an exploded perspective view of the pan toy according to the embodiment as viewed obliquely from the bottom-rear side.

The individual components of the pan toy 3 will be described below. FIG. 3 is an exploded perspective view of the pan toy 3 as viewed obliquely from the top-front side. FIG. 4 is an exploded perspective view of the pan toy 3 as viewed obliquely from the bottom-rear side.

The pan main body 4 includes a pan frame member 41 (frame member) and the pan bottom member 42 formed radially inside the pan frame member 41. The pan frame member 41 is approximately shaped like a truncated cone pipe that is increased in diameter upward and are open at the top and the bottom. The manipulation portion 43 which is modeled on a long, flat handle extends from a front portion of the outer side surface of the pan frame member 41. The height of the pan frame member 41 varies in the circumferential direction in such a manner as to be a little greater on the side of a rear frame portion 41*a* than on the front side where the manipulation portion 43 is provided. Bearing portions 411 are formed on a rear portion of the outer side surface of the pan frame member 41. The support shafts 221 are engaged with the respective bearing portions 411, whereby the pan frame member 41 can be rotated in the vertical direction about the axis located in the rear of the cooking stove 22.

A bottom end portion, on the side of the manipulation portion 43, of the pan frame member 41 is formed with two restrictive projections 413 which restrict lowering limit positions of the pan frame member 41. When the pan frame member 41 is rotated downward toward the cooking stove 22, the restrictive projections 413 come into contact with the bottoms of groove portions 222 (see FIG. 1) formed at front positions in the cooking stove 22, respectively, to restrict the movement. A pushing portion 412 to come into contact with a contact portion 521 of the first movable member 52 (described later) is formed between the restrictive projections 413.

As shown in FIG. 4, the pan bottom member 42 (placement member) is approximately shaped like a circular disc. The pan bottom member 42 is disposed on outer circumference of the pan frame member 41 so as to close the bottom opening of the pan frame member 41. The bottom surface of the pan bottom member 42 is formed with a fixing hole 421 (screw hole; see FIG. 4) by which the pan bottom member 42 is fixed to the cooking stove 22. The fixing state of the pan bottom member 42 relative to the cooking stove 22 is constant irrelevant to the rotation movement of the frame member 41. In other words, the frame member 41 is rotatable relative to the pan bottom member 42. The cooking target Fd (object) is placed on the top surface of the pan bottom member 42 (see FIGS. 5A and 5B to FIG. 7).

The hitting mechanism 5 is equipped with a housing member 51 which is fixed to a bottom portion of the cooking stove 22 and the first movable member 52 and the second movable member 53 which are disposed slidably in the housing member 51. The housing member 51 is shaped like a rectangular pipe that is closed at the bottom. The front wall of the housing member 51 is formed with a rectangular cut 511 which extends downward from the top edge of the front wall.

A partition wall 512 which is shaped like a long flat plate is erected leftward from the right inner wall surface (see FIG. 3) of the housing member 51. The partition wall 512 extends in the vertical direction from the bottom end of the housing member 51 to its top end. The left inner wall surface, opposed to the partition wall 512, of the housing member 51 is formed with a groove 513. The groove 513 also extends in the vertical direction from the bottom end of the housing member 51 to its top end.

The first movable member 52 is housed in a first housing portion 517 located in front of the partition wall 512 of the housing member 51, slidably in the vertical direction. The second movable member 53 is housed in a second housing portion 518 located in the rear of the partition wall 512 of the housing member 51, slidably in the vertical direction.

Approximately cylindrical projections 514 and 515 are provided in the first housing portion 517 and the second housing portion 518, respectively. The projection 514 is formed at a right-hand position in the width direction of the housing member 51 and projects from approximately the same level as the lower edge of the cut 511. The projection 514 is provided at a position higher than that of the projection 515.

The left inner wall surface of the housing member 51 is formed with a guide portion 516 which is adjacent to the projection 514 from the left side. The tip of the guide portion 516 defines an approximately semicircular arc in a side view as viewed from inside the housing member 51. The guide portion 516 is formed so as to stride the front edge of the groove 513 in the front-rear direction.

The first movable member 52 is shaped like a rectangular pipe that is closed at the top. A rectangular-prism-shaped contact portion 521 capable of coming into contact with the pan frame member 41 project from the top end of the first movable member 52 at a front position. The tip portion 521*a* of the contact portion 521 is flat.

A bottom portion of the rear side surface of the first movable member 52 is formed with a first projection 522 (engaging portion). The first projection 522 has a flat slant portion 522*a* and thereby projects rearward more as the position goes downward. A rear side surface, above the first projection 522, of the first movable member 52 is formed with a shallow recess 523 which extends in the vertical direction.

The first movable member 52 has a housing portion 524 having a bottom opening. A coil spring S1 which is an elastic member is housed in the housing portion 524. A bottom end portion of the coil spring S1 is wound on and supported by the projection 514 shown in FIG. 3 etc.

Like the first movable member 52, the second movable member 53 is shaped like a rectangular pipe that is closed at the top. Slits 531 and 532 are formed in the front wall and the left side wall of the second movable member 53 so as to extend upward from the bottom end, whereby a long, approximately rectangular elastic portion 533 is formed. The elastic portion 533 is shaped like a cantilever-shaped leaf spring that can be deformed elastically in the front-rear direction with its top end as a supporting point. A bottom end portion of the front surface of the elastic portion 533 is formed with a second projection 534 (engaged portion). The second projection 534 has a flat slant portion 534*a* and thereby projects forward more as the position goes upward. The slit 532 which is formed in the left side wall of the second movable member 53 is formed with a slant edge 532*a* (inside edge) that is opposed to the elastic portion 533. The slant edge 532*a* is formed in a bottom portion of the slit 532 so that the slit width increases as the position goes downward. This secures a wide rearward rotatable range of the elastic portion 533.

A hitting portion 536 projects from the top end of the second movable member 53 on the side of the first movable member 52 so as to be connected to the top end of the second movable member 53 by a rectangular-prism-shaped neck portion 535. The hitting portion 536 is formed so as to project forward from the neck portion 535 so as to have a slant portion 536*a* (see an enlarged view of part P as viewed from direction A in FIG. 3) on the front side of the neck portion 535. The hitting portion 536 also has a slant portion 536*c* on the rear side of a tip portion 536*b* of the hitting portion 536. Thus, the center of the tip portion 536*b* to come into contact with the pan bottom member 42 is located on the front side of the center of the neck portion 535.

As shown in FIG. 4, the second movable member 53 has a housing portion 537 which is open at the bottom. A coil spring S2 which is an elastic member is housed in the housing portion 537. A bottom portion of the coil spring S2 is wound on and supported by the projection 515 shown in FIG. 3 etc.

The top surface, in the rear of the hitting portion 536, of the second movable member 53 is formed with a recess 538 which is recessed so as to assume an approximately U shape. The recess 538 serves as a relief for preventing the second movable member 53 from interfering with a screw Sc (see FIG. 5A) in fixing the pan bottom member 42 to the cooking stove 22.

Figure 5B:
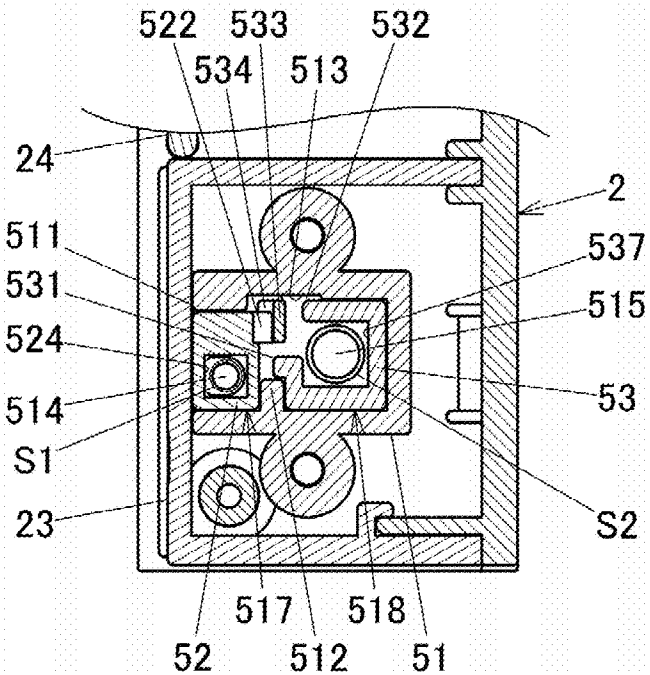
FIG. 5B is a sectional view of the kitchen toy taken along line Vb-Vb in FIG. 5A.
Figure 5A:
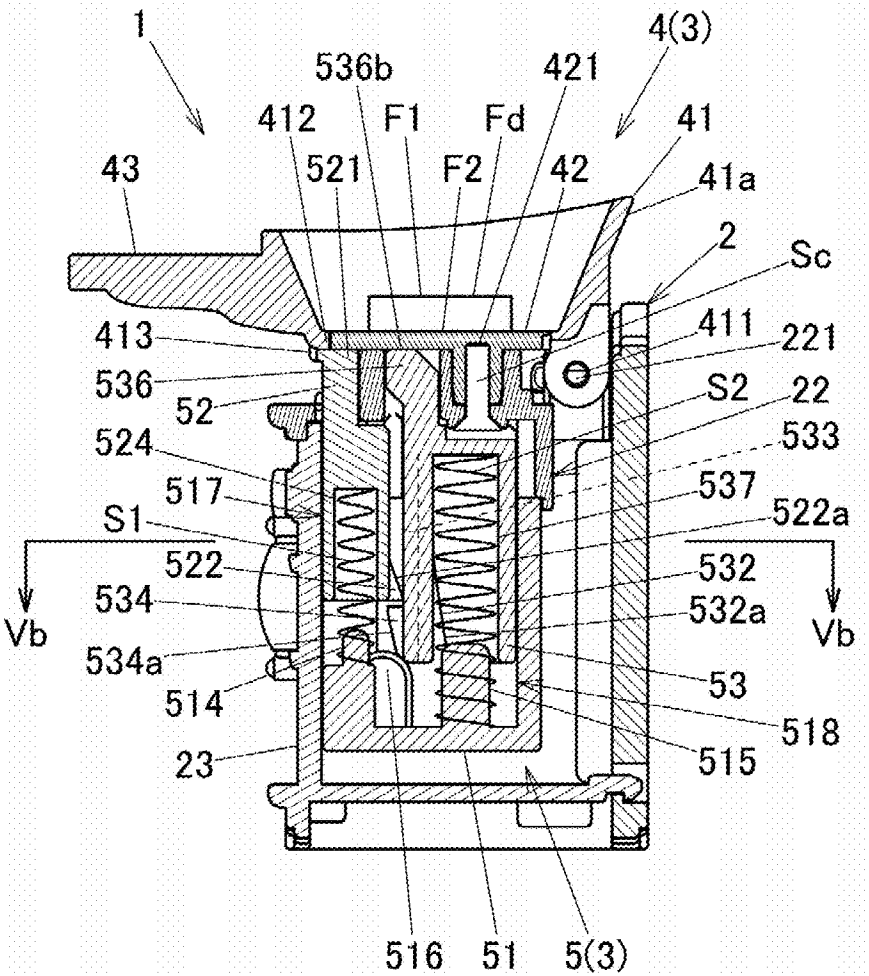
FIG. 5A is a sectional view of the kitchen toy according to the embodiment taken along line Va-Va in FIG. 1

Next, a description will be made of how the pan toy 3 and the members around it are assembled together. FIG. 5A is a sectional view of the kitchen toy 1 taken along line Va-Va in FIG. 1. FIG. 5B is a sectional view of the kitchen toy 1 taken along line Vb-Vb in FIG. 5A. As shown in FIG. 3, the front projection 514 is located on the right side of the rear projection 515. FIG. 5A is a composite sectional view in which a front portion of the housing member 51 is cut by a plate that passes through the center of the projection 514 and a rear portion of the housing member 51 is cut by a plate that passes through the center of the projection 515 (the same applies to FIGS. 6 and 7).

As shown in FIG. 5B, a movement of the first movable member 52 in the right-left direction is restricted by the inner wall surfaces of the first housing portion 517. A rearward movement of the first movable member 52 is restricted by the partition wall 512, and a forward movement of the first movable member 52 is restricted by the inner wall surface of the outer wall 23. A movement of the second movable member 53 in the right-left direction and a rearward movement of the second movable member 53 are restricted by the inner wall surfaces of the second housing portion 518. A forward movement of the second movable member 53 is restricted by the partition wall 512. Thus, the first movable member 52 and the second movable member 53 are housed in the first housing portion 517 and the second housing portion 518, respectively, so as to be slidable in the vertical direction.

Next, a description will be made of how the pan toy 3 operates. The vertical distance from the tip portion 521*a* which is the pan-bottom-member-42-side end of the first movable member 52 to its first projection 522 is shorter than that from the tip portion 536*b* which is the pan-bottom-member-42-side end of the second movable member 53 to the second projection 534. Thus, in a standby state shown in FIG. 5A, the second projection 534 of the second movable member 53 is located under the first projection 522 of the first movable member 52. In this state, the contact portion 521 of the first movable member 52 is urged by the coil spring 51 from below and is thereby in contact with the pushing portion 412, formed in the lower edge, of the pan frame member 41. The hitting portion 536 of the second movable member 53 is urged by the coil spring S2 from below and is thereby in contact with the pan bottom member 42. The tip portion 536*b* of the second movable member 53 is in contact with the pan bottom member 42 at a position that is located on the front side of the center of the pan bottom member 42, that is, on the side closer to the first movable member 52 than the center of the pan bottom member 42 is.

When a player pushes down the manipulation portion 43 of the pan toy 3 being in the standby state, the pushing portion 412 of the pan frame member 41 pushes down the contact portion 521 of the first movable member 52 against the elastic force of the coil spring S1. The pan frame member 41 is configured so as to be able to rotate in such a manner that the support shafts 221 located on the opposite side of the pan bottom member 42 with respect to the first movable member 52 serves as the fulcra, the manipulation portion 43 serves as the point of effort, and a portion of the lower edge portion of the pan frame member which is located between (e.g., substantially center portion between) the fulcra and the point of effort and is in contact with the first movable member 52 (i.e., the pushing portion 412 of the pan frame member 41) serves as the point of action.

Figure 6B:
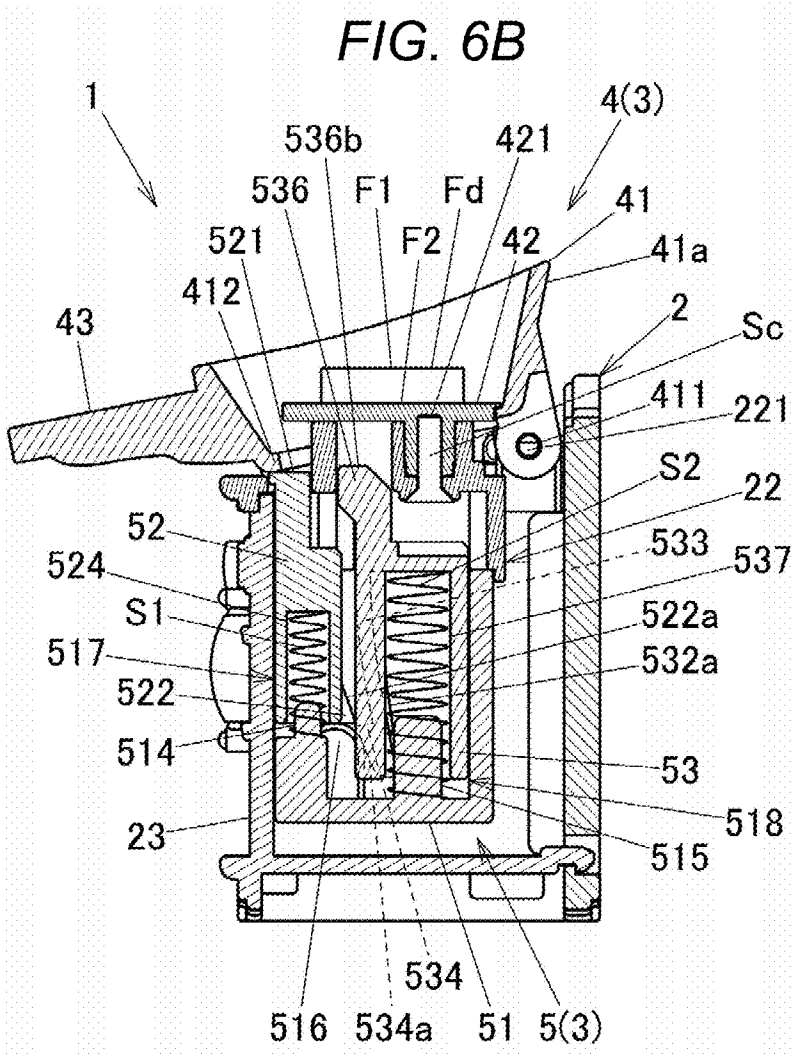
FIGS. 6A and 6B show how the pan toy according to the embodiment operates.
Figure 6A:
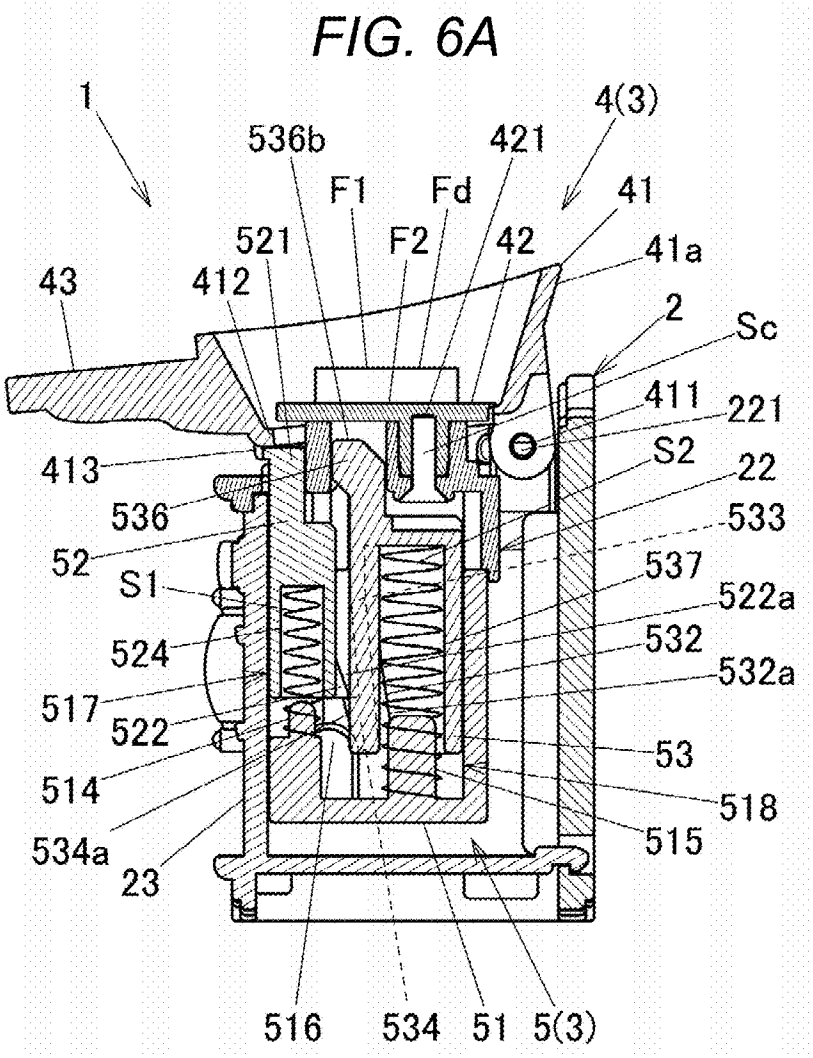

In response, as shown in FIG. 6A, the first projection 522 of the first movable member 52 engages with (comes into contact with) and then pushes down the second projection 534 of the second movable member 53. The second movable member 53 goes down against the elastic force of the coil spring S2. When the second movable member 53 goes down in the second housing portion 518, the slant portion 534*a* of the second projection 534 comes into contact with the guide portion 516. Since the slant surface 534*a* comes into contact with the rear surface of the guide portion 516 which is curved to define a semicircular arc in a side view, the elastic portion 533 including the second projection 534 is bent rearward against the elastic force. As a result, the second projection 534 recedes away from the first projection 522, whereby the engagement between the second projection 534 and the first projection 522 becomes weak (i.e., the contact area decreases).

When the manipulation portion 43 is pushed down further as shown in FIG. 6B, the first movable member 52 and the second movable member 53 go down further and the second projection 534 of the second movable member 53 recedes further from the first projection 522, whereby the second projection 534 is disengaged from the first projection 522.

Figure 7:
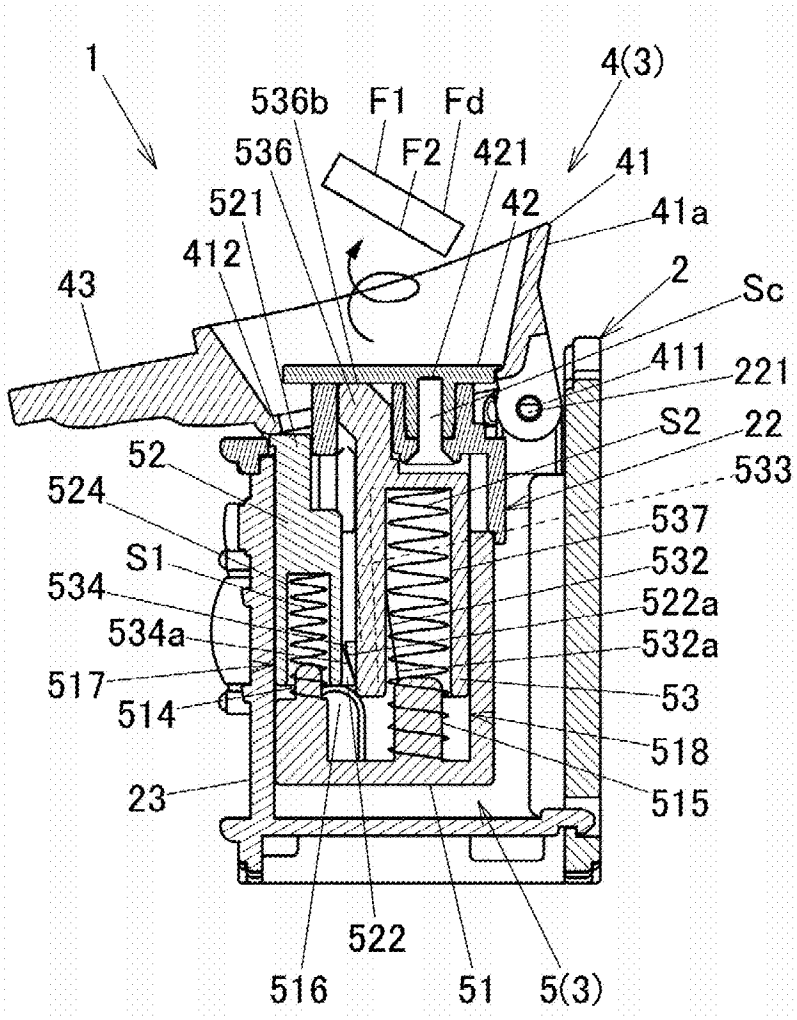
FIG. 7 shows another operation of the pan toy according to the embodiment that the second movable member hits a pan bottom member.

When the second projection 534 is disengaged from the first projection 522, as shown in FIG. 7 the second movable member 53 is moved up fast toward the pan bottom member 42 by the elastic force of the coil spring S2 while being guided by the second housing portion 518. As a result, the tip portion 536*b* of the hitting portion 536 of the second movable member 53 collides with the bottom surface of the pan bottom member 42 and exerts impact on the pan bottom member 42. The hitting portion 536 collides with the pan bottom member 42 at a position that is located on the front side of the center of the pan bottom member 42, that is, on the side closer to the first movable member 52 than the center of the pan bottom member 42 is. As a result, the cooking target Fd that has been put on the pan bottom member 42 springs upward or up a little rearward. The frame height of the pan frame member 41 is a little greater on the side of the rear frame portion 41*a*. This not only allows the player to see the cooking target Fd easily from the from side but also easily prevents the cooking target Fd from dropping out of the pan main body 4 by the rear frame portion 41*a* even when it springs up rearward.

When the player releases the manipulation portion 43, the first movable member 52 is elevated by the elastic force of the coil spring S1 being guided by the first housing portion 517 and returns to the position where it was located when the pan toy 3 was in the standby state. The player can cause the cooking target Fd to spring up repeatedly by repeating the manipulation of pushing down the manipulation portion 43.

For example, to mimic cooking of baking both surfaces of a pancake, the cooking target Fd may be such that its one surface F1 is given a pattern and a color before the cooking (e.g., no pattern and a bright original color of a material) and its other surface F2 is given a pattern and a color that would be obtained after the cooking (e.g., a grid-like pattern and a dark color that would be obtained by baking). The cooking target Fd spring up when receiving impact from below from the pan bottom member 42 and then drops onto the pan bottom member 42 with its surface F1 or F2 up randomly. The front surface of the cooking target Fd changing between the surfaces F1 and F2 mimics the cooking target Fd being cooked.

The above-described embodiment of the invention can provide model toys and pan toys 3 having the following features.

In a first aspect of the invention, there is provided a model toy including: a placement member; a first movable member which includes an engaging portion and which is movable to a position that is distant from the placement member; a second movable member which is urged toward the placement member, which includes an engaged portion that is engaged with the engaging portion when the first movable member is moved, and which is movable to a position that is distant from the placement member; and a guide portion which changes a path of one or both of the engaging portion and the engaged portion as the second movable member is moved, to disengage the engaged portion from the engaging portion.

According to the first aspect, the second movable member 53 can exert impact on the placement member from below when a player performs a manipulation of moving the manipulation portion 43 in one direction (in the embodiment, pushes down the manipulation portion 43), whereby an object placed on the placement member, such as the cooking target Fd, can be flipped easily by causing it to spring up. In this manner, the player can enjoy by changing the state of the object placed on the placement member easily.

In a second aspect of the invention, there is provided the model toy according to the first aspect of the invention, further including: a frame member which is formed on an outer circumference of the placement member and which is configured to push down the first movable member to the position that is distant from the placement member; and a long manipulation portion which is integrally connected to the frame member.

According to the second aspect, the pan frame member 41 configured to contact the first movable member 52 can be easily pushed down using the manipulation portion 43, and the object such as the cooking target Fd that has sprung up can be prevented from dropping out of the placement member at landing of the object.

In a third aspect of the invention, there is provided the model toy according to the second aspect of the invention, wherein the frame member is rotatable such that a portion located on an opposite side of the placement member with respect to the first movable member serves as a fulcrum, the manipulation portion serves as a point of effort, and a portion of a lower edge portion of the frame member which is located between the fulcrum and the point of effort and which is configured to contact the first movable member serves as a point of action.

According to the third aspect, it possible to move the first movable member 52 easily by a weak force by manipulating the manipulation portion 43.

In a fourth aspect, there is provided the model toy according to any one of the first to third aspects of the invention, wherein a tip portion of the second movable member is configured to contact the placement member at a position closer to the first movable member than a center of the placement member.

According to the fourth aspect, it is possible to easily cause the object such as the cooking target Fd placed on the placement member to spring up a little obliquely toward the side opposite to the first movable member 52.

In a fifth aspect, there is provided the model toy according to any one of the first to fourth aspects of the invention, wherein the first movable member is urged toward the placement member, wherein the engaging portion is a first projection fixed to the first movable member, wherein the engaged portion is a second projection that is provided on the second movable member through an elastic portion, wherein the first projection includes a slant portion provided on a side of the placement member, wherein the second projection includes a slant portion on a side opposite to the placement member, and wherein a distance from an end of the first movable member located on the side of the placement member to the engaging portion is shorter than a distance from an end of the second movable member located on the side of the placement member to the engaged portion.

According to the fifth aspect of the invention, by releasing the manipulation of the first movable member 52 after causing the second movable member 53 to hit the placement member, the first movable member 52 can be returned automatically to its original standby position (i.e., both of the first movable member 52 and the second movable member 53 can be returned to their initial positions where they are in contact with the pan main body 4). Thus, the player can easily exert impact on the placement member repeatedly by repeating the manipulation of pushing down the first movable member 52 in the one direction.

In a sixth aspect of the invention, there is provided the model toy according to the fifth aspect of the invention, further including: a housing member including a first housing portion that houses the first movable member slidably and a second housing portion that is partially separated from the first housing portion by a partition wall and houses the second movable member slidably, wherein the elastic portion, the engaging portion, and the engaged portion are located beside the partition wall.

According to the sixth aspect of the invention, a space necessary for engagement and disengagement of the engaged portion (in the embodiment, second projection 534) with and from the engaging portion (in the embodiment, first projection 522) can be secured while the first movable member 52 and the second movable member 53 can be guided stably in their sliding directions.

In a seventh aspect of the invention, there is provided a pan toy including: a pan bottom member; a first movable member which includes an engaging portion and which is movable to a position that is distant from the pan bottom member; a second movable member which is urged toward the pan bottom member, which includes an engaged portion that is engaged with the engaging portion when the first movable member is moved, and which is movable to a position that is distant from the pan bottom member; a guide portion which changes a path of one or both of the engaging portion and the engaged portion as the second movable member is moved, to disengage the engaged portion from the engaging portion; a pan frame member which is formed on an outer circumference of the pan bottom member and which is configured to push down the first movable member to the position that is distant from the pan bottom member; and a long handle which is integrally connected to the pan frame member.

According to the seventh aspect, the second movable member 53 can exert impact on the pan bottom member 42 from below when a player performs a manipulation of moving the manipulation portion 43 in one direction (in the embodiment, pushes down the manipulation portion 43), whereby the cooking target Fd placed on the pan bottom member 42 can be flipped easily by causing it to spring up. Furthermore, the pan frame member 41 configured to contact the first movable member 52 can be easily pushed down using the manipulation portion 43, and the cooking target Fd that has sprung up can be prevented from dropping out of the pan bottom member 42 at landing of the cooking target Fd. In this manner, the player can enjoy by changing the state of the cooking target Fd placed on the pan bottom member 42 of the pan main body 4 during or after cooking easily.

Although the embodiment of the invention has been described above, the invention is not limited by the embodiment and various modifications are possible. For example, although in the embodiment the coil spring S1 is set inside the housing portion 524 of the first movable member 52, the coil spring S1, the housing portion 524, and the projection 514 may be omitted, in which case the first movable member 52 is returned manually to its initial position where it is adjacent to the pan main body 4. The first movable member 52 may be brought into contact with the pan main body 4 by urging the first movable member 52 through engagement between the first projection 522 and the second projection 534 caused by the coil spring S2 of the second movable member 53.

The first projection 522 and the second projection 534 may have other shapes in which case one of them serves as an engaging portion and the other serves as an engaged portion (e.g., a projection and a groove).

In the embodiment, when the second movable member 53 is moved to the position that is distant from the pan bottom member 42, the guide portion 516 changes the path of the second projection 534 to disengage the second projection 534 from the first projection 522. However, a modification is possible in which the first movable member 52 is provided with the first projection 522 via an elastic portion and a guide portion 516 changes the path of the first projection 522. A further alternative structure is possible in which the paths of both of the first projection 522 and the second projection 534 are changed.

In the embodiment, the coil spring S1 and the coil spring S2 urge the first movable member 52 and the second movable member 53, respectively. However, the coil springs may be replaced with any urging members or mechanisms configured to apply urging forces to the first movable member 52 and the second movable member 53, respectively.

Although the embodiment is directed to the pan toy 3 having the pan bottom member 42 as the placement member, the invention can also be applied to another form of model toy in which the state of the object is changed by causing it to spring up by exerting vibration to a placement member. Among other model toys to which the invention can be applied are toys that are modeled on a toaster, an oven, and a kiln.

The invention claimed is:

1. A model toy comprising:

a placement member;

a first movable member which comprises an engaging portion and which is movable together with the engaging portion, to a position that is distant from the placement member;

a second movable member which is urged toward the placement member, which comprises an engaged portion that is engaged with the engaging portion of the first movable member when the first movable member is moved towards the position that is distant from the placement member, and which is movable, together with the engaged portion, to a position that is distant from the placement member by the engagement of the engaged portion with the engaging portion and the movement of the first movable member; and a guide portion which comes into contact with and changes a path of one or both of the engaging portion and the engaged portion as the second movable member is moved towards the position that is distant from the placement member, to disengage the engaged portion from the engaging portion.

2. The model toy according to claim 1, further comprising:

a frame member which is formed on an outer circumference of the placement member and which is configured to push down the first movable member to the position that is distant from the placement member; and a long manipulation portion which is integrally connected to the frame member.

3. The model toy according to claim 2, wherein the frame member is rotatable such that a portion located on an opposite side of the placement member with respect to the first movable member serves as a fulcrum, the manipulation portion serves as a point of effort, and a portion of a lower edge portion of the frame member which is located between the fulcrum and the point of effort and which is configured to contact the first movable member serves as a point of action.

4. The model toy according to claim 1, wherein a tip portion of the second movable member is configured to contact the placement member at a position closer to the first movable member than a center of the placement member.

5. The model toy according to claim 1, wherein the first movable member is urged toward the placement member, wherein the engaging portion is a first projection fixed to the first movable member, wherein the engaged portion is a second projection that is provided on the second movable member through an elastic portion, wherein the first projection comprises a slant portion provided on a side of the placement member, wherein the second projection comprises a slant portion on a side opposite to the placement member, and wherein a distance from an end of the first movable member located on the side of the placement member to the engaging portion is shorter than a distance from an end of the second movable member located on the side of the placement member to the engaged portion.

6. The model toy according to claim 5, further comprising:

a housing member comprising a first housing portion that houses the first movable member slidably and a second housing portion that is partially separated from the first housing portion by a partition wall and houses the second movable member slidably, wherein the elastic portion, the engaging portion, and the engaged portion are located beside the partition wall.

7. A pan toy comprising:

a pan bottom member;

a first movable member which comprises an engaging portion and which is movable together with the engaging portion, to a position that is distant from the pan bottom member;

a second movable member which is urged toward the pan bottom member, which comprises an engaged portion that is engaged with the engaging portion of the first movable member when the first movable member is moved towards the position that is distant from the pan bottom member, and which is movable, together with the engaged portion, to a position that is distant from the pan bottom member by the engagement of the engaged portion with the engaging portion and the movement of the first movable member;

a guide portion which comes into contact with and changes a path of one or both of the engaging portion and the engaged portion as the second movable member is moved towards the position that is distant from the pan bottom member, to disengage the engaged portion from the engaging portion;

a pan frame member which is formed on an outer circumference of the pan bottom member and which is configured to push down the first movable member to the position that is distant from the pan bottom member; and a long handle which is integrally connected to the pan frame member.

* * * * *